US006039536A

United States Patent [19]

Van De Venne et al.

[11] Patent Number: 6,039,536

[45] Date of Patent: Mar. 21, 2000

[54] CONNECTION BETWEEN A ROTOR HUB AND A SHAFT OF AN ELECTRIC MOTOR OF AN ELECTRICALLY DRIVEN AIR PUMP

[75] Inventors: Gunter Van De Venne, Monchengladbach; Frank Kemmerling, Grevenbroich; Michael Bonse, Dusseldorf; Klaus Muckelmann, Hilden; Rainer Peters, Goch, all of Germany

[73] Assignee: Pierburg AG, Neuss, Germany

[21] Appl. No.: 09/163,637

[22] Filed: Sep. 30, 1998

[30] Foreign Application Priority Data

Sep. 30, 1997 [DE] Germany ..... 197 43 069

[51] Int. Cl.[7] ..... F01D 25/00

[52] U.S. Cl. ..... 415/216.1; 416/213 R; 416/213 A; 416/244 R

[58] Field of Search ..... 415/216.1; 416/213 R, 416/213 A, 244 R, 244 A, 204 R; 403/268, 266, 265

[56] References Cited

U.S. PATENT DOCUMENTS

| | | | |
|---|---|---|---|
| 2,857,849 | 10/1958 | Pezzillo . | |
| 5,212,607 | 5/1993 | Elsing et al. | 360/99.08 |
| 5,632,685 | 5/1997 | Myers | 464/183 |
| 5,634,724 | 6/1997 | Zang et al. | 384/107 |
| 5,797,727 | 8/1998 | Peters et al. . | |

FOREIGN PATENT DOCUMENTS

| | | |
|---|---|---|
| 0385298 | 9/1990 | European Pat. Off. . |
| 2384973 | 10/1978 | France . |
| 1963212 | 6/1967 | Germany . |
| 4107049 | 9/1992 | Germany . |
| 19611512 | 9/1997 | Germany . |

OTHER PUBLICATIONS

Hahn G. "Verbindungstechnik Fur Kermamische Bauteile." Konstruktion, bd. 38, NV.9, (1986) pp. 359–363).

*Primary Examiner*—Edward K. Look
*Assistant Examiner*—Ninh Nguyen
*Attorney, Agent, or Firm*—Ladas & Parry

[57] ABSTRACT

An improvement in an electrical air pump having a housing with a pump mechanism at one end and an electric motor at the other end. The pump mechanism has at least one lightweight pump impeller made of plastic whose hub is press-fit on a shaft of the electric motor. The hub is provided with a plurality of grooves distributed around a bore in the hub which receives the motor shaft. The grooves form spaces between an inner surface of the hub and an outer surface of the shaft and the spaces are filled with an adhesive to bond the hub to the shaft. The grooves extend longitudinally or spirally along the entire length of the hub. The grooves are relatively shallow and have a depth of approximately 0.05 mm.

3 Claims, 2 Drawing Sheets

CONNECTION BETWEEN A ROTOR HUB AND A SHAFT OF AN ELECTRIC MOTOR OF AN ELECTRICALLY DRIVEN AIR PUMP

FIELD OF THE INVENTION

The invention relates to an electrically driven air pump, for example, for motor vehicles, in which secondary air is supplied to the exhaust system of the internal combustion engine to improve the quality of the exhaust.

The invention relates particularly to an improved connection between the rotor hub of the pump impeller and the shaft of the electric motor.

BACKGROUND

EPO 0 385 298 A2 shows such a pump but is has the problem that its operation is unavoidably associated with vibrations of variable magnitude, based on imbalance of the impeller and the electric motor as well as the magnetic rotating field that is produced. The vibrations are transmitted to the apparatus connected to the pump, and cause a high-frequency operating noise.

In order to reduce this noise, it has been proposed in DE-A1 41 07 049.6 to support the electric motor by means of two elastic motor mounts between the electric motor and the surrounding housing. The pump impeller in this citation has several parts, which must be counterbalanced.

U.S. Pat. No. 2,857,849 discloses a pump in which several pumpimpellers are attached to an electric motor shaft, by a screw connection. Since the threads of the screw connection must be sufficiently rigid, it is concluded that the impellers are made of metal. These are heavy and have large inherent imbalances.

An electric air pump of this type is disclosed in DE 196 11 512.4 and its equivalent U.S. Pat. No. 5,797,727, in which the pump mechanism has one or more pump impellers, injection-molded of plastic, whose impeller hubs are press-fit onto an electric motor shaft and bear against a stop ring in the direction they are press-fit on the shaft and the hubs are secured by a metal locking ring press-fit on the shaft at the end opposite the collar. The contacting surfaces of the impellers and the locking ring that contact one another are formed with an interlocking tooth and groove arrangement.

This construction provides a low noise operation of the pump since lighter pump impellers can be used. In addition, a very simple construction for the electrical air pump is obtained with this design, which can be produced at relatively low cost.

However, it has been found that the plastic impeller hubs press-fit on the motor shaft can nevertheless rotate on the motor shaft which leads to an axial displacement of the impeller and the locking ring, whereby the function and performance of the electric air pump are adversely affected and impact noise on the stop ring may occur.

Experiments were conducted using adhesives between the impeller hubs and the motor shaft to prevent slippage, but due to gaps in the adhesive between the hubs and the shaft, the hubs continued to loosen leading to the above disadvantages.

SUMMARY OF THE INVENTION

An object of the invention is to provide an electric air pump in which the impeller hub of the rotor is fixedly secured to the motor shaft thereby to avoid the above noted disadvantages in the known art.

Another object is to produce such an electrical air pump with a simple construction and at relatively low cost and especially wherein operating noise is reduced and remains so during the life of the electric air pump.

In accordance with the invention, the hubs of one or more impellers which are press-fit on the shaft of the electric motor are each provided with a plurality of shallow grooves distributed around the bore of the hub into which the motor shaft is press-fit said grooves forming spaces between the mating surfaces of the hub and shaft into which an adhesive is filled to bond the hub and shaft.

In further accordance with the invention, the grooves extend longitudinally or spirally along the length of the hub.

In order not to impair the structural integrity of the hub and yet retain the adhesive, the grooves have a depth of approximately 0.05 mm.

DETAILED DESCRIPTION

Figure 1:
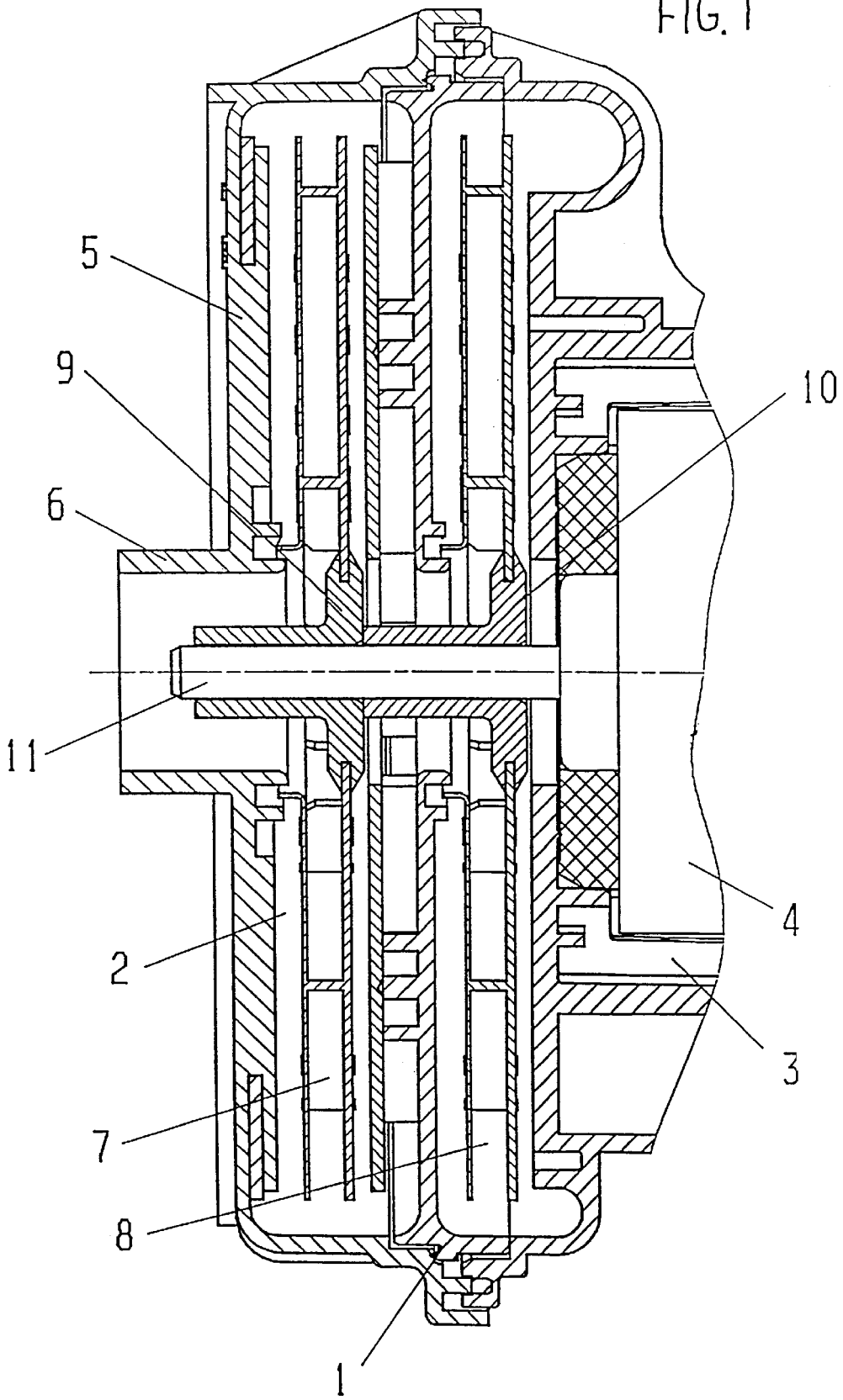
FIG. 1 is a longitudinal, sectional view of a portion of an electrical air pump illustrating an embodiment of the invention.

FIG. 1 shows an electric air pump comprising a housing 1, which receives a pump mechanism 2 at one end and an electric motor 4 in a motor chamber 3 at the other end. Housing 1 is closed at the pump end by a cover 5, which has an air inlet 6.

Pump mechanism 2 includes two pump impellers 7, 8 which, have respective integral hubs 9, 10 press-fit on a shaft 13 of the electrical motor 4. The impellers and hubs are made of lightweight plastic material.

Figure 2:
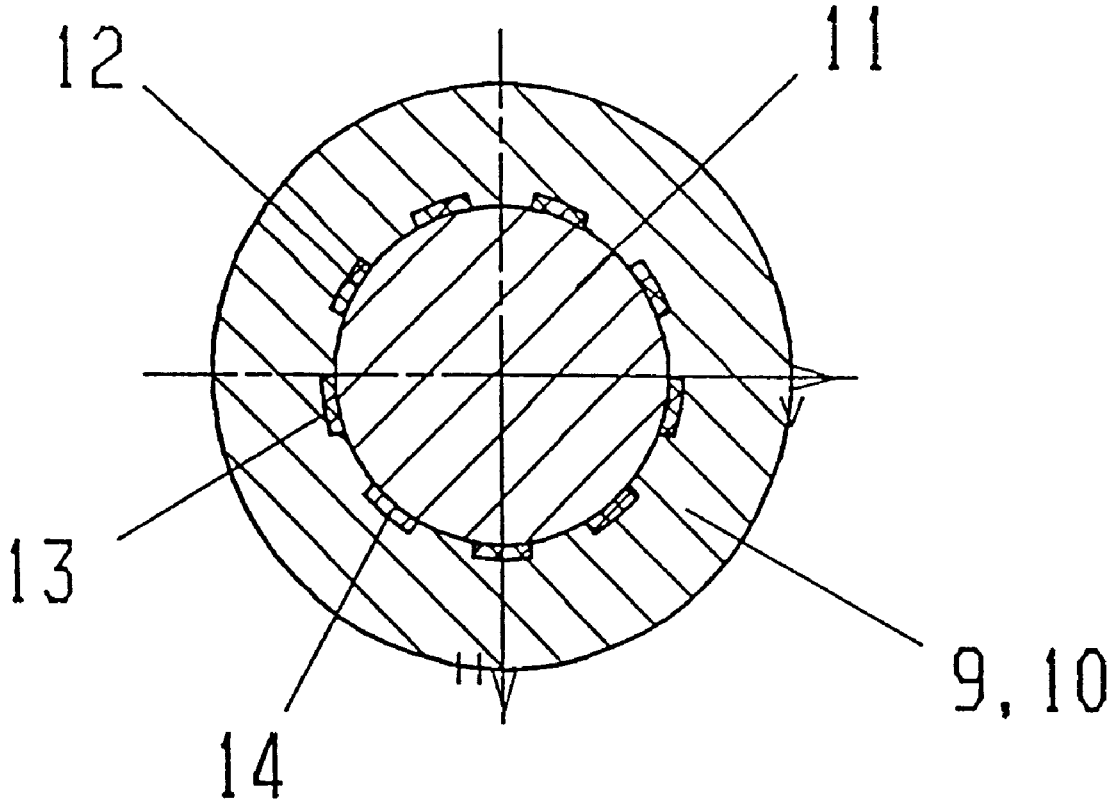
FIG. 2 is an enlarged cross-section through the connection of the motor shaft and the impeller hub in the electrical air pump in FIG. 1.

As shown in FIG. 2, the impeller hubs 9, 10 are each formed with grooves 13 distributed uniformly around the bore 12 in which the shaft 11 is press-fit. The grooves 13 form open spaces between the inner surface of the respective hub and the shaft. In order to bond the hubs 9, 10 to the shaft 13 on which they are press-fit, the grooves are filled with an adhesive 14. The adhesive 14 can be any conventional adhesive which is effective to bond the plastic hubs to the motor shaft whether the latter is made of metal or plastic.

The grooves 13 can extend longitudinally or spirally along the length of the hubs. The grooves 13 are relatively shallow and have a depth of approximately 0.05 mm.

The pump impeller hubs 9, 10, made of plastic, may be integrally formed with the pump impellers 7, 8 in an injection-molding process or they can be injection-molded onto a pump impeller plate to form the pump impeller (not shown).

A much reduced noise operation is made possible with the electric air pump according to the invention, since lighter pump impellers can be used. In addition, a very simply constructed electric air pump is made available according to the invention, which can be produced at low cost and with a long service life.

Although the invention is disclosed with reference to particular embodiments thereof, it will become apparent to those skilled in the art that numerous modifications and variations can be made which will fall within the scope and spirit of the invention as defined by the attached claims.

What is claimed:

1. In an electric air pump having a housing with a pump mechanism at one end and an electric motor at the other end, the pump mechanism having at least one pump impeller made of plastic material and having a hub which is press-fit on a shaft of the electric motor, the improvement wherein said hub of the at least one pump impeller has a plurality of grooves distributed around a bore in the hub which receives the motor shaft, said grooves forming spaces between an inner surface of said hub and an outer surface of said shaft, and an adhesive in said grooves to bond said hub to said shaft.

2. The improvement as claimed in claim 1, wherein said grooves extend longitudinally or spirally along said hub.

3. The improvement as claimed in claim 2, wherein said grooves have a depth of approximately 0.05 mm.

* * * * *